US011589684B2

(12) United States Patent
Chuah

(10) Patent No.: US 11,589,684 B2
(45) **Date of Patent: *Feb. 28, 2023**

(54) BABY SEAT CARRIER

(71) Applicant: Khai Gan Chuah, Austin, TX (US)

(72) Inventor: Khai Gan Chuah, Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/806,348

(22) Filed: Jun. 10, 2022

(65) Prior Publication Data

US 2022/0296006 A1 Sep. 22, 2022

Related U.S. Application Data

(63) Continuation of application No. 16/854,812, filed on Apr. 21, 2020, now Pat. No. 11,382,438.

(60) Provisional application No. 62/871,060, filed on Jul. 5, 2019.

(51) Int. Cl.
*A47D 13/02* (2006.01)

(52) U.S. Cl.
CPC ..... *A47D 13/025* (2013.01)

(58) Field of Classification Search
CPC ..... A47D 13/025
USPC ..... 224/158, 160, 161
See application file for complete search history.

(56) References Cited

U.S. PATENT DOCUMENTS

| | | | |
|---|---|---|---|
| D222,005 | S | 9/1971 | Kelly |
| 3,893,731 | A | 7/1975 | Maggs |
| 4,009,808 | A | 3/1977 | Sharp |
| 4,271,998 | A | 6/1981 | Ruggiano |
| D266,044 | S | 9/1982 | Blanchard |
| D274,576 | S | 7/1984 | Tiffany |
| 4,458,834 | A | 7/1984 | Rosen |
| 4,579,264 | A | 4/1986 | Napolitano |
| 4,718,715 | A | 1/1988 | Ho |
| 4,901,898 | A | 2/1990 | Colombo et al. |
| 4,941,604 | A | 7/1990 | Nagareda |
| 5,020,709 | A | 6/1991 | Hoaglan |
| 5,178,309 | A | 1/1993 | Bicheler et al. |
| 5,224,637 | A | 7/1993 | Colombo |
| 5,230,450 | A | 7/1993 | Mahvi et al. |
| 5,292,042 | A | 3/1994 | Yamaguchi et al. |
| D346,702 | S | 5/1994 | Jackson |

(Continued)

FOREIGN PATENT DOCUMENTS

| | | | |
|---|---|---|---|
| DE | 102011055894 | A1 | 6/2013 |
| EP | 3760082 | A1 | 1/2021 |

(Continued)

OTHER PUBLICATIONS

U.S. Appl. No. 29/693,889, Jun. 5, 2019, Khai Gan Chuah, Entire Document.

(Continued)

*Primary Examiner* — Justin M Larson
(74) *Attorney, Agent, or Firm* — Craige Thompson; Thompson Patent Law; Timothy D. Snowden

(57) ABSTRACT

The present invention relates to a baby carrier consisting of shoulder straps, a main panel, and side panels with adjustable height. The lower aspect of the main panel consists of a seat component with a belt around the waist to secure the baby in place. The purpose of the adjustable positioning system is to change the angle of the seat component in order to accommodate for the increase downward movement of the solid seat component caused by heavy weight.

20 Claims, 8 Drawing Sheets

(56) References Cited

U.S. PATENT DOCUMENTS

| | | | |
|---|---|---|---|
| D363,598 | S | 10/1995 | Walters et al. |
| D370,996 | S | 6/1996 | Shimura et al. |
| 5,570,823 | A | 11/1996 | Lindy |
| D377,116 | S | 1/1997 | Shimura et al. |
| 5,657,912 | A | 8/1997 | Nakayama |
| D388,954 | S | 1/1998 | Nakayama |
| 5,791,535 | A | 8/1998 | Roan et al. |
| 6,019,510 | A | 2/2000 | Gonzalez et al. |
| D425,696 | S | 5/2000 | Swanke |
| 6,098,857 | A | 8/2000 | Gal |
| 6,409,060 | B2 | 6/2002 | Donine |
| D468,901 | S | 1/2003 | Thornber |
| 6,789,710 | B1 | 9/2004 | Szatkowski |
| D507,102 | S | 7/2005 | Bergkvist et al. |
| D509,056 | S | 9/2005 | Shiraishi et al. |
| D548,986 | S | 8/2007 | McCoy et al. |
| 7,510,104 | B2 | 3/2009 | Taylor |
| D596,411 | S | 7/2009 | May |
| D611,699 | S | 3/2010 | Lundh |
| D615,750 | S | 5/2010 | Jones et al. |
| D623,401 | S | 9/2010 | Bergkvist et al. |
| D623,402 | S | 9/2010 | Bergkvist et al. |
| D642,375 | S | 8/2011 | Zack et al. |
| D642,815 | S | 8/2011 | Kelly et al. |
| D645,263 | S | 9/2011 | Taylor, IV |
| 8,028,871 | B2 | 10/2011 | Gray |
| D649,345 | S | 11/2011 | Bergkvist et al. |
| D655,494 | S | 3/2012 | Murray et al. |
| D655,495 | S | 3/2012 | Sauer et al. |
| 8,172,116 | B1 | 5/2012 | Lehan et al. |
| D664,351 | S | 7/2012 | Bergkvist et al. |
| D692,227 | S | 10/2013 | Andren et al. |
| D693,569 | S | 11/2013 | Lehan |
| 8,579,168 | B2 | 11/2013 | Zack et al. |
| D698,142 | S | 1/2014 | Cha et al. |
| 8,701,949 | B1 | 4/2014 | Lehan et al. |
| D711,090 | S | 8/2014 | Schroder |
| D712,134 | S | 9/2014 | Gunter et al. |
| D714,045 | S | 9/2014 | Stave et al. |
| D733,419 | S | 7/2015 | Wikner et al. |
| D740,043 | S | 10/2015 | Lee |
| D742,629 | S | 11/2015 | Nam |
| D753,385 | S | 4/2016 | Stave et al. |
| 9,314,112 | B2 | 4/2016 | Chuah |
| D755,508 | S | 5/2016 | Chuah |
| 9,386,863 | B1 | 7/2016 | Antunovic |
| D783,269 | S | 4/2017 | Lucas et al. |
| 9,700,152 | B2 | 7/2017 | Telford et al. |
| 9,788,664 | B2 | 10/2017 | Andren et al. |
| D803,549 | S | 11/2017 | Warfaa et al. |
| D807,025 | S | 1/2018 | Elmberg et al. |
| D811,082 | S | 2/2018 | Lehan |
| 9,949,575 | B2 | 4/2018 | Pond et al. |
| D835,902 | S | 12/2018 | Young |
| D841,976 | S | 3/2019 | Formans |
| 10,264,895 | B2 | 4/2019 | Lindeman et al. |
| 10,271,663 | B2 | 4/2019 | Salazar et al. |
| D849,397 | S | 5/2019 | Tsai |
| D851,916 | S | 6/2019 | Andersson et al. |
| D856,661 | S | 8/2019 | Lee |
| D858,089 | S | 9/2019 | Tsai |
| 10,433,656 | B2 | 10/2019 | Lundh |
| 10,441,091 | B2 | 10/2019 | Salazar et al. |
| 10,694,867 | B2 | 6/2020 | Troutman et al. |
| 10,702,074 | B2 | 7/2020 | Najafi et al. |
| 10,750,879 | B2 | 8/2020 | Schachtner |
| 10,820,721 | B2 | 11/2020 | Lindeman et al. |
| D919,959 | S | 5/2021 | Chuah |
| 11,051,634 | B2 | 7/2021 | Telford |
| D940,451 | S | 1/2022 | Chuah |
| 11,357,338 | B2 * | 6/2022 | Fulcher, Jr. ..... A47D 13/02 |
| 11,382,438 | B2 * | 7/2022 | Chuah ..... A47D 13/025 |
| 2005/0045675 | A1 | 3/2005 | Redlinger et al. |
| 2005/0051582 | A1 | 3/2005 | Frost |
| 2005/0184114 | A1 | 8/2005 | Hoff et al. |
| 2007/0235479 | A1 | 10/2007 | Bangert |
| 2007/0246493 | A1 | 10/2007 | Kemkamp |
| 2008/0087694 | A1 | 4/2008 | Meng et al. |
| 2008/0283559 | A1 | 11/2008 | Parness et al. |
| 2009/0026235 | A1 | 1/2009 | Gray |
| 2009/0302075 | A1 | 12/2009 | Trainer |
| 2010/0072236 | A1 | 3/2010 | Parness et al. |
| 2010/0147910 | A1 | 6/2010 | Schachtner |
| 2010/0308088 | A1 | 12/2010 | Lindblom |
| 2011/0062195 | A1 | 3/2011 | Jones et al. |
| 2011/0089205 | A1 | 4/2011 | Coote |
| 2011/0290831 | A1 | 12/2011 | Wang |
| 2012/0061429 | A1 | 3/2012 | Sauer |
| 2012/0187162 | A1 | 7/2012 | Bergkvist et al. |
| 2012/0241487 | A1 | 9/2012 | Zack et al. |
| 2012/0298702 | A1 | 11/2012 | Jung et al. |
| 2014/0231472 | A1 | 8/2014 | Cha |
| 2014/0263491 | A1 | 9/2014 | Telford et al. |
| 2015/0196133 | A1 | 7/2015 | Rosen et al. |
| 2015/0201761 | A1 | 7/2015 | Wollenberg |
| 2015/0282639 | A1 | 10/2015 | Chuah |
| 2016/0227940 | A1 | 8/2016 | Wikner et al. |
| 2016/0286980 | A1 | 10/2016 | Telford et al. |
| 2017/0119173 | A1 | 5/2017 | Telford |
| 2017/0196374 | A1 | 7/2017 | Chen |
| 2018/0116426 | A1 | 5/2018 | Telford |
| 2018/0206653 | A1 | 7/2018 | Andrus et al. |
| 2018/0296005 | A1 | 10/2018 | Tsai |
| 2019/0014920 | A1 | 1/2019 | Matsuyama |
| 2019/0350380 | A1 | 11/2019 | Tsai |
| 2020/0268169 | A1 | 8/2020 | Telford |
| 2020/0297129 | A1 | 9/2020 | Schachtner |
| 2021/0000265 | A1 | 1/2021 | Chuah |
| 2021/0137282 | A1 | 5/2021 | Duhaime |
| 2021/0345793 | A1 | 11/2021 | Lee et al. |
| 2021/0361079 | A1 | 11/2021 | Salazar et al. |
| 2022/0047095 | A1 * | 2/2022 | Gilboa ..... A47D 13/025 |

FOREIGN PATENT DOCUMENTS

| | | | |
|---|---|---|---|
| JP | 2017202139 | A | 11/2017 |
| JP | 2021010733 | A | 2/2021 |
| WO | 2017200451 | A1 | 11/2017 |
| WO | 2020058872 | A1 | 3/2020 |

OTHER PUBLICATIONS

U.S. Appl. No. 29/712,816, Nov. 12, 2019, Khai Gan Chuah, Entire Document.

U.S. Appl. No. 29/719,449, Jan. 53, 2019, Khai Gan Chuah, Entire Document.

JMMD Baby Carrier with Hip Seat for Newborn & Infant & Toddler . . . https://www.amazon.eom/J MM D-Designed-Ergonomic-Position-Traveling/dp/B08ZYKQQJ D/ref=cm_cr_arp_d_pl_foot_top?ie=UTF8 (Year: 2021).

* cited by examiner

BABY SEAT CARRIER

CROSS-REFERENCE TO RELATED APPLICATIONS

This application is a continuation application and claims the benefit of U.S. application Ser. No. 16/854,812, titled "BABY SEAT CARRIER," filed by Khai Gan Chuah, on Apr. 21, 2020, which application claims the benefit of U.S. Provisional Application Ser. No. 62/871,060, titled "BABY SEAT CARRIER," filed by Khai Gan Chuah, on Jul. 5, 2019.

This application incorporates the entire contents of the foregoing application(s) herein by reference.

The subject matter of this application may have common inventorship with and/or may be related to the subject matter of the following:

U.S. patent application Ser. No. 14/247,406 titled "Baby Carrier with Removable Seat," filed Apr. 8, 2014 by Khai Gan Chuah;

U.S. patent application Ser. No. 29/501,398 titled "Booster Seat Baby Carrier," filed Sep. 3, 2014 by Khai Gan Chuah;

U.S. patent application Ser. No. 29/559,553 titled "Baby Carrier Seat Insert," filed Mar. 29, 2016 by Khai Gan Chuah and issued as U.S. Pat. No. D790,235;

U.S. patent application Ser. No. 29/693,889 titled "Baby Carrier," filed Jun. 5, 2019 by Khai Gan Chuah;

U.S. patent application Ser. No. 29/712,816 titled "Hip Seat Carrier," filed Nov. 12, 2019 by Khai Gan Chuah; and, U.S. patent application Ser. No. 29/719,449 titled "Hip Carrier," filed Jan. 3, 2020 by Khai Gan Chuah."

This application incorporates the entire contents of the foregoing application(s) herein by reference.

TECHNICAL FIELD

Various embodiments relate generally to a baby carrier with means to accommodate a seat insert at different angles to improve seating comfort for baby.

BACKGROUND

A baby seat carrier (U.S. Pat. No. 9,314,112) consists of a main carrier, shoulder straps, waistband and seat compartment formed together to accomplish its usability. The purpose of the seat compartment is to fit a seat insert (i.e. solid seat) to support the child's weight when being carried in the carrier, promoting better support and alignment of the pelvis and spine. However, as the child grows heavier, due to the weight asserted on the seat insert, the lower part of baby seat carrier (i.e. seat compartment and waistband) begins to sag. The centralized pressure creates a downward stress towards the lower abdomen of user by the seat insert.

This invention introduces a method to improve the weight distribution in between the waist belt and the seat compartment as the baby weight increases over time. The improvement would allow the user to reduce the abnormal strain of the waist belt and the sagging of the seat component, thereby be able to wear the baby carrier with better comfort.

SUMMARY

The present invention relates to a baby seat carrier with positioning system. More related to the invention, the seat component of the carrier consists of seat compartment and side panels. The side panel further consists of positioning system with means to allow the waist belt to be connected to baby seat carrier at user's desired position. The seat component can also be part of the main panel or part of the waist belt construction. The purpose of the seat compartment is to enclose a seat insert to support the baby's weight when being carried in the carrier, promoting better support and alignment of the pelvis and spine. The enclosed seat insert preferred to be a solid material but it can also come in other forms of materials. The seat component can be further secured onto the user by a waist belt to reduce excess movement of the baby during carrying. Further weight distribution can also be achieved with a waist belt consisting of lumbar support.

The seat component can be attached to the waist belt by an interlocking system to become adjustable to the user's comfort. The interlocking system can be of any fitting locking systems such as Velcro, buckles, stitches, buttons, zippers and/or loop hooks. The interlocking system can also be spread out onto various locations throughout the lower panel at different positions, to reach optimal suspension. The waist belt, in its entirety, can also be attached to and detached from the seat component using the interlocking system. By having this type of system, it allows a variety of positions the waist belt to be set onto the carrier in order to fit the user. Waist belts can be of different sizes and designs to fit the user, medically or cosmetically, it can also become part of the seat component as one entity. Waist belts can also have lumbar supports to provide a better weight distribution throughout the user's back, to minimize back strain.

DETAILED DESCRIPTION OF ILLUSTRATIVE EMBODIMENTS

Figure 1:
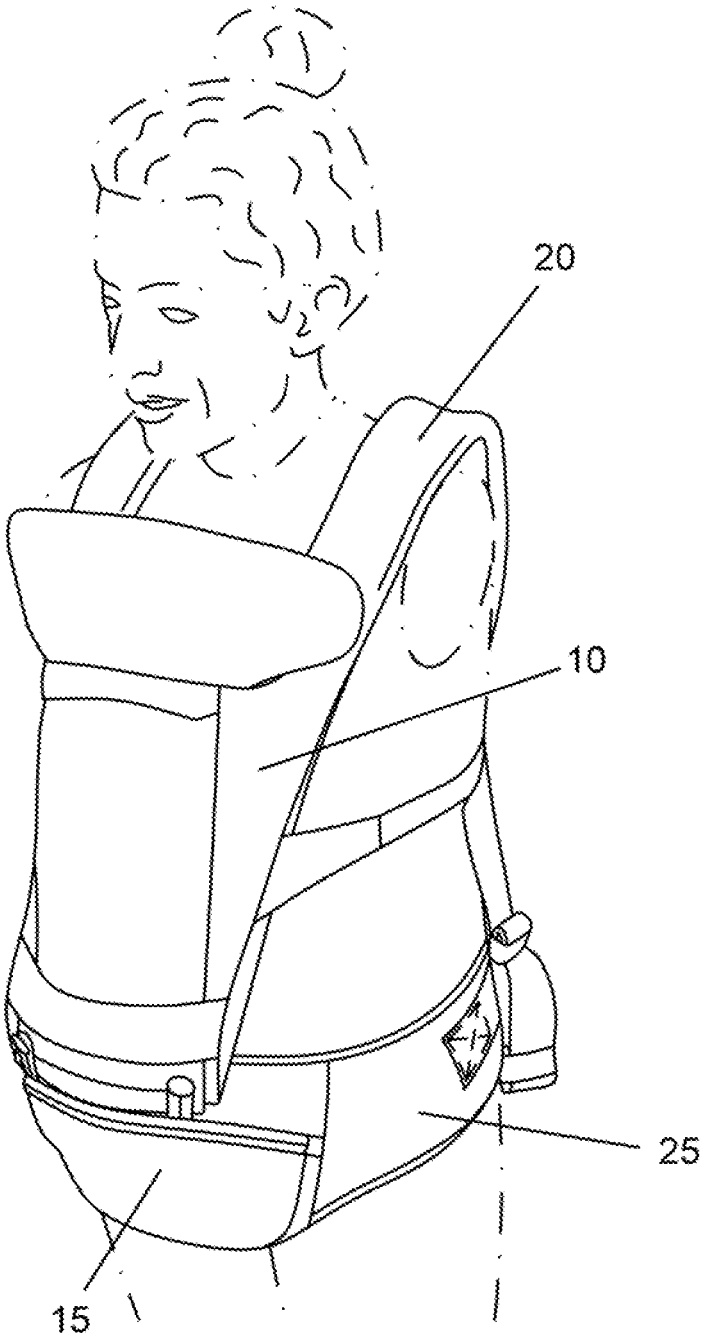
FIG. 1 is a perspective view of a regular baby seat carrier without the present invention, shown being mounted on the front of the user.
Figure 2:
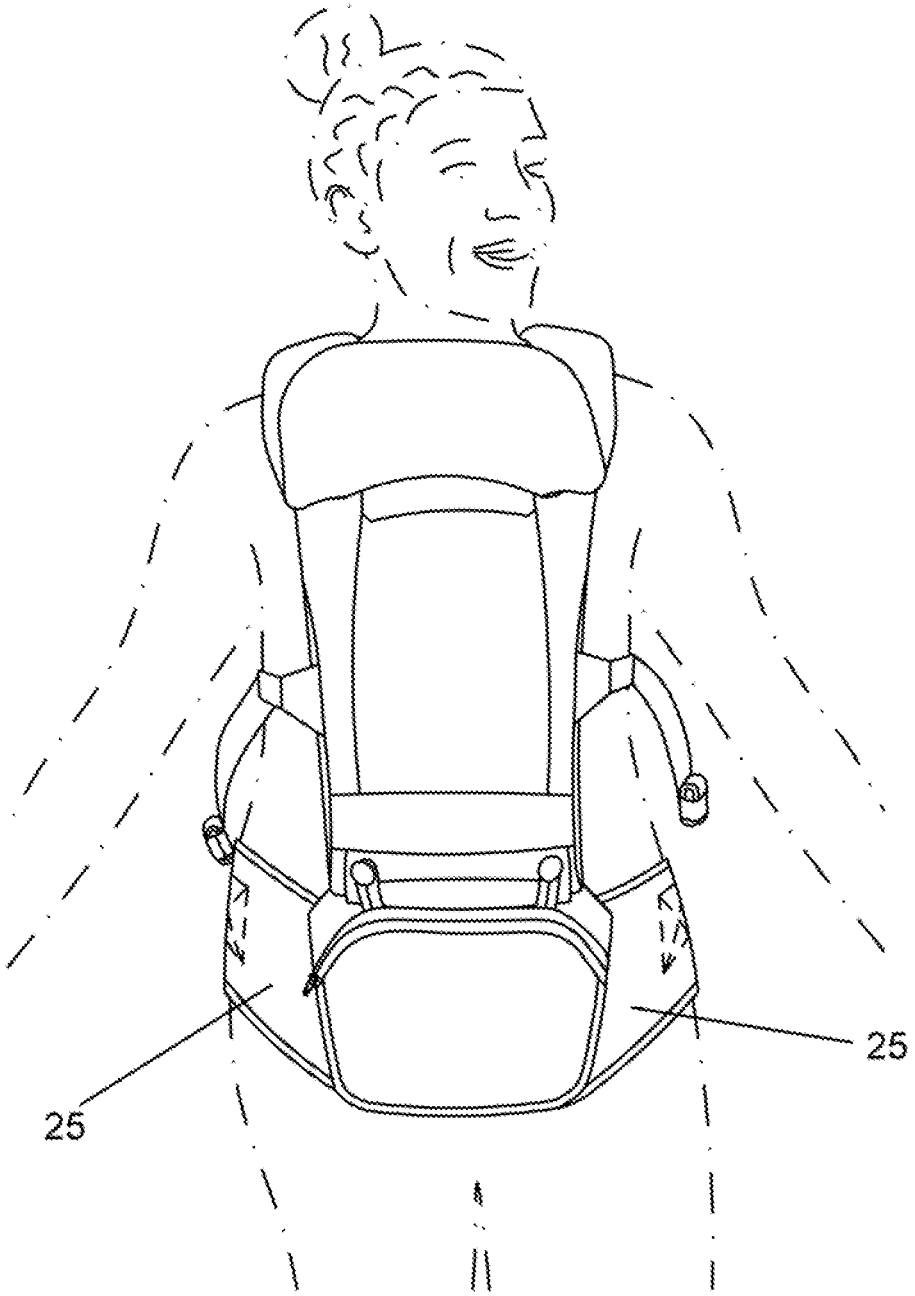
FIG. 2 is a front view of a regular baby seat carrier without the present invention.
Figure 3:
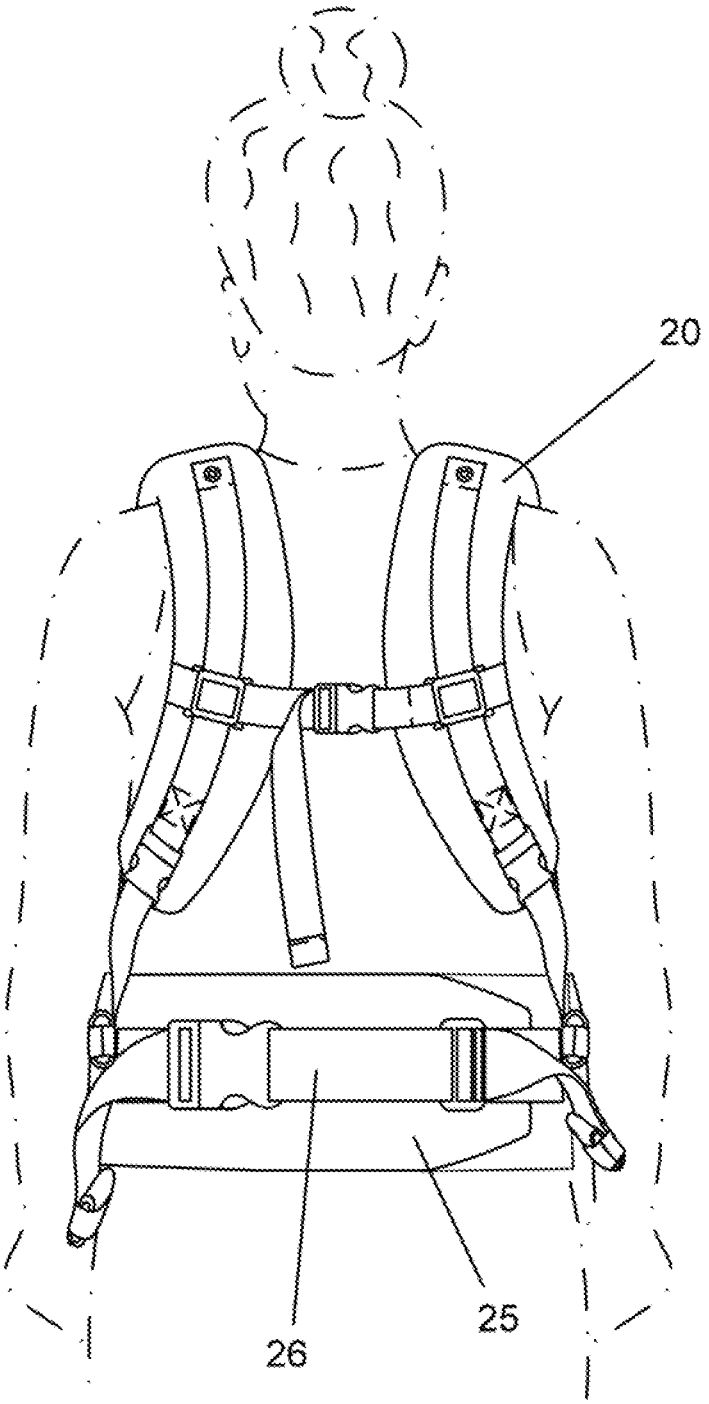
FIG. 3 is a rear view of a regular baby seat carrier without the present invention.
Figure 4A:
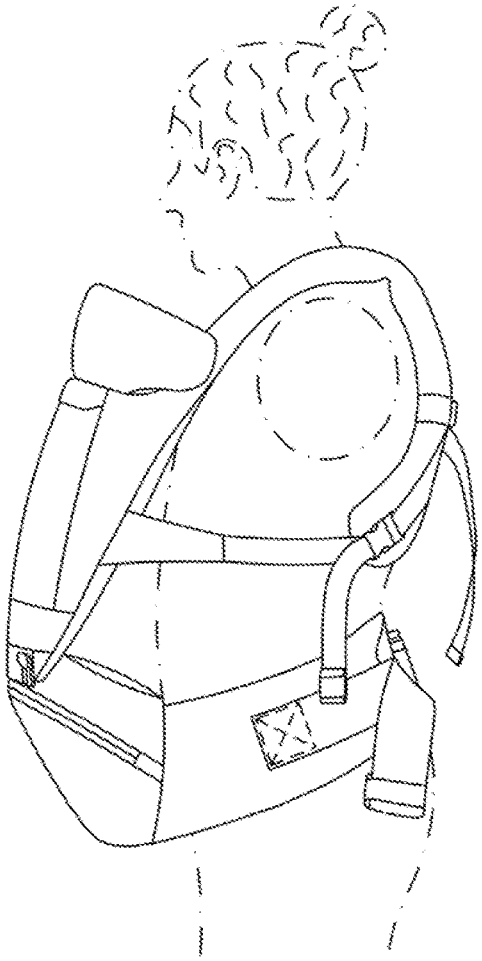
FIG. 4A is a side view of a baby seat carrier when carrying a light load (not shown) without the present invention.
Figure 4B:
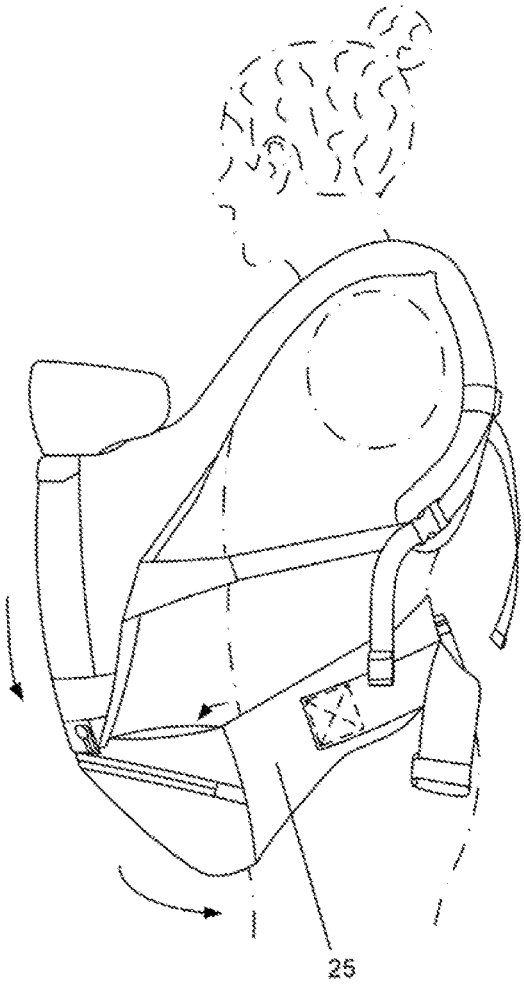
FIG. 4B is a side view of a baby seat carrier when carrying a heavy load (not shown) without the present invention.

FIG. 1, FIG. 2, FIG. 3, FIG. 4A and FIG. 4B depicts a baby seat carrier come without positioning system. The general part of this baby seat carrier comprises a main panel 10, seat compartment 15, shoulder strap structure 20, waistband 25 and restraint system 26. The seat compartment 15 is positioned at lower aspect of the main panel 10. FIG. 3 shows waistband 25 strapped around the user's waist to keep the baby carrier in position. A typical baby carrier can be used from 6 months to 3 years old. When a smaller child is in the carrier (not shown), the carrier rests comfortably on the user (FIG. 4A). As the child grows older and heavier (such as 18 months and above), the seat compartment 15 tends to be pushed downward, creating a wider angle between the seat surface and abdomen. FIG. 4B depicts the downward slide, seat compartment 15 "digging into" the lower abdomen, and a deformed waistband 25 as the load (not shown) increases.

Figure 5:
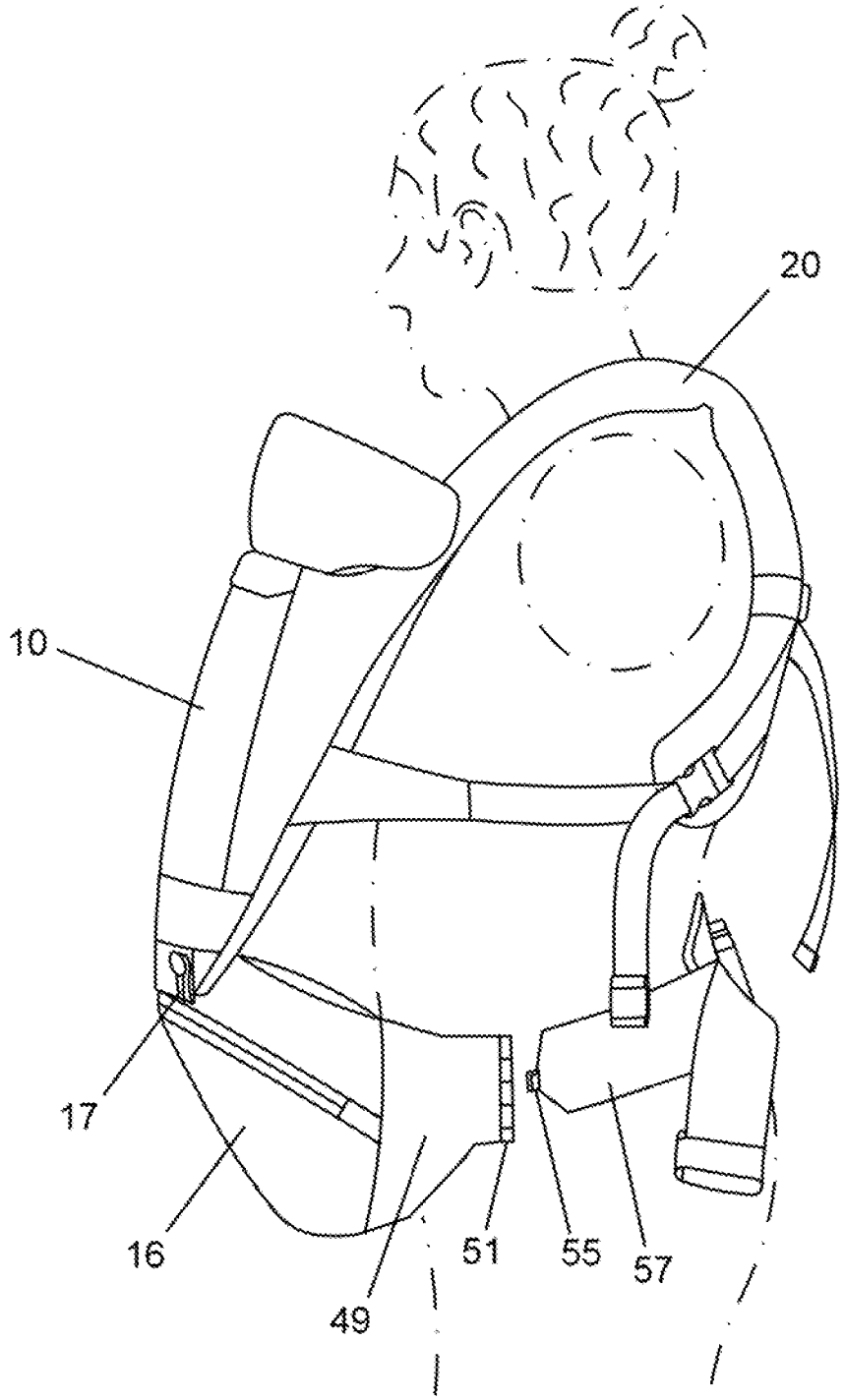
FIG. 5 is a side view of a baby seat carrier of the present invention.
Figure 8:
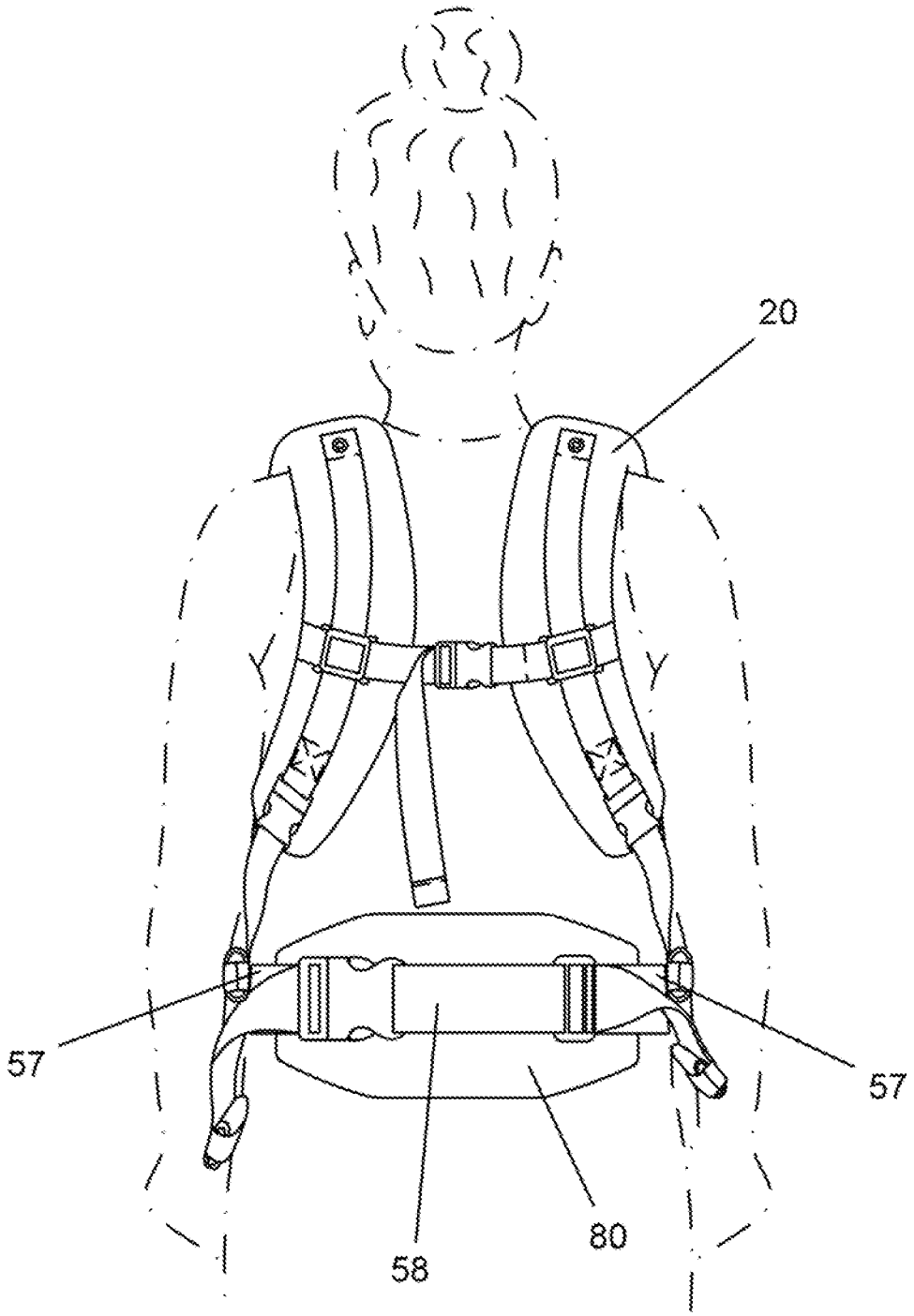
FIG. 8 is a rear view of the baby carrier of the present invention.

FIG. 5 shows the baby carrier with the present invention. The general parts of the carrier include the main panel 10, seat component, shoulder strap structure 20, and waist belt 57, restraint system 58 (FIG. 8) and lumbar support 80 (FIG. 8). The use of waistband in prior art to strap around the user's waist to keep the baby carrier in position has been omitted. The lumbar support 80 is added in the present invention for user comfort, due to the omission of waistband.

Figure 6:
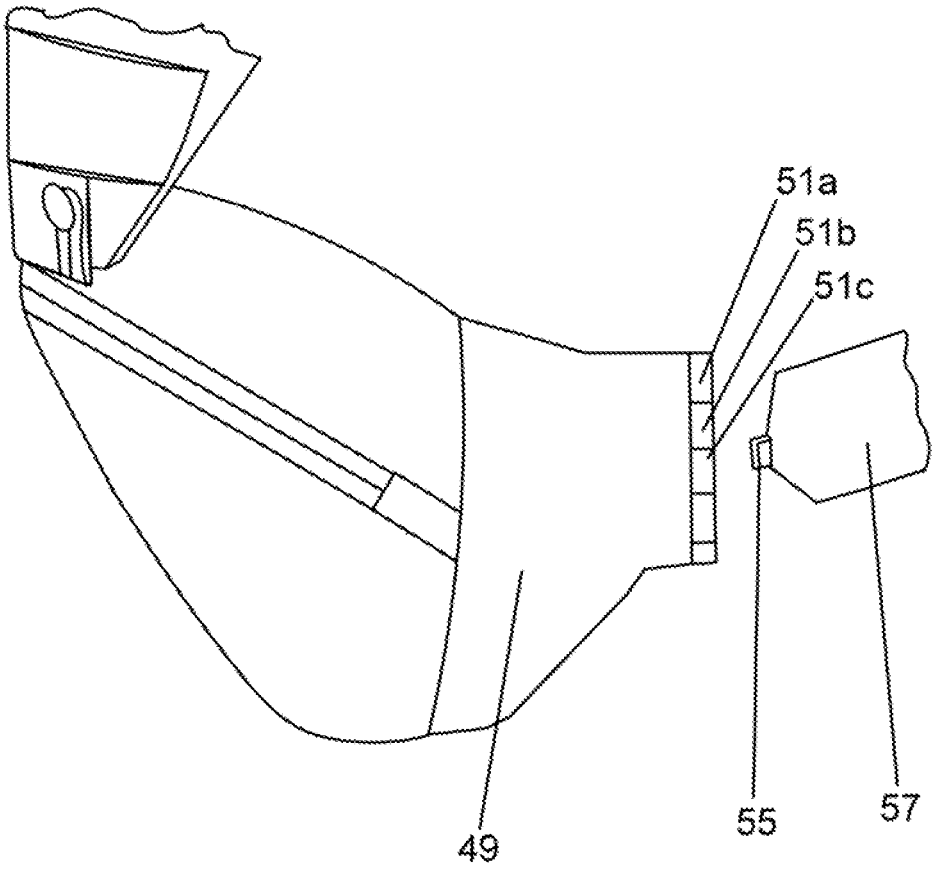
FIG. 6 is a partial view of a baby seat carrier, showing the positioning system of the present invention.

The seat component comprises of seat compartment 16 and side panels 49. The side panels 49 are present on the left and right side of the baby seat compartment. The side panel 49 is not a waistband. Its primary purpose is to accommodate a positioning system at one end, while on the other end to hold the seat compartment in place. The purpose of the seat compartment 16 is to enclose a seat insert (not shown), for means of providing a seat support for the baby while being carried. The seat component can be either part of the main panel 10, or an attachment to the main panel 10 by way of an interlocking system 17. The interlocking system can be in the form of, but not limited to, buckles, buttons, fasteners, zipper, and/or connectors. The side panel 49 is further extended to another interlocking system, in this case, the positioning system 51 with means to engage with the connector 55 of the waist belt 57. The positioning system 51 may come in different position settings, for example 51 *a*, 51 *b*, 51 *c* (FIG. 6), with means to interlock with the connector 55 of the waist belt 57. The connector 55 can also be part of waist belt 57 or as a separate entity.

In the beginning, the positioning system 51 may be set at the lower position, in this case 51 *c*, for most comfortable position to use the carrier. As the child grows heavier, the weight of child pushes the seat component downward, in which case the user may adjust the connector 55 to a different position setting such as 51 *a* or 51 *b* to counter the downward force.

It is to be noted that the seat compartment 16 can be part of the side panels 49 as an entity or be attached to the side panels 49 as a different entity. The side panels 49, positioning system 51, connector 55, waist belt 57, restraint system 58, lumbar support 80 and other subsequent components can be manufactured into various sizes, shapes and materials depend on the market segmentation.

Figure 7:
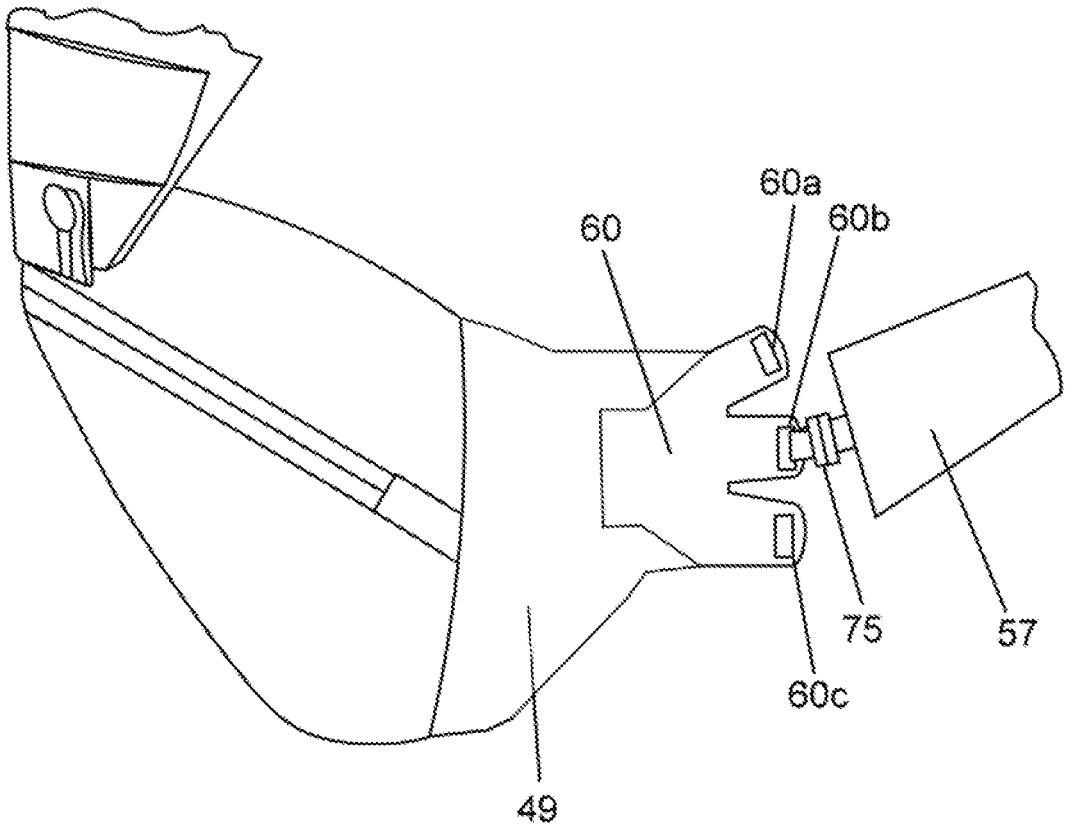
FIG. 7 a partial view of a baby seat carrier, showing the positioning system according to another embodiment of the present invention.

Another embodiment of the invention, shown in FIG. 7. The positioning system 60 arranged in different angle settings, for example 60 *a*, 60 *b*, and 60 *c* with means to connect with the connector 75 of the waist belt 57. The positioning system 60 can be part of the side panel 49 as one entity or be attached to the side panel 49 as a different entity.

The positioning system, and connector 75 can be in forms such as using Velcro, fastener, buttons, strap, hooks, loops, tab, stitches and/or buckles as long as it is achieving locking effect. It is to be noted the angle setting of positioning system can vary according to the target market. The connector 75 can be part of waist belt 57 or restraint system 58 or as a separate entity.

It is to be noted the connector 75, and/or positioning system 60, and/or fastener, can also be permanently sewn together with side panels 49 to form a single angle setting. In this case, the baby carrier may be designed with one angle setting per model (or SKU) for a user to select the most suitable fit for his or her torso. Much like selecting clothes with different sizes, S, M, L, XL, the baby seat carrier may come in different prefix angle settings such as 0-degree, 30-degree, and 45-degree waist belt. The waist belt 57 further engages with restraint system 58 to completely secure the carrier around the user's waist. It is to be noted that the positioning system 60 can be made with similar material to the baby seat carrier component such as side panels or waist belt or it can be of different materials. These materials may carry properties that include, but not limited to, rigid, semi-rigid, flexible, gel-type, foam-type material. The side panels 49, positioning system 60, connector 75, waist belt 57, restraint system 58, lumbar support 80 and other subsequent components can be manufactured into various sizes, shapes and materials.

What is claimed is:

1. A baby carrier comprising:

a main panel comprising a lower portion;

a seat component having a medial region configured to couple to the lower portion of the main panel, the seat component comprising:

at least one seat compartment; and a first side panel and a second side panel each coupled to a corresponding side region of the at least one seat compartment and each comprising a terminal end;

a pair of shoulder straps coupled to the main panel;

at least one waist belt comprising a first terminal end and a second terminal end;

at least one lumbar support coupled to the at least one waist belt; and, at least one positioning system configured to:

releasably couple the terminal end of the first side panel to the first terminal end of the at least one waist belt such that the terminal end of the first side panel extends along a corresponding first belt axis, and the first terminal end of the at least one waist belt extends along a corresponding first seat axis, wherein the first seat axis and the first belt axis are at a first predetermined angle relative to each other, and, releasably couple the terminal end of the second side panel to the second terminal end of the at least one waist belt such that the terminal end of the second side panel extends along a corresponding second belt axis, and the second terminal end of the at least one waist belt extends along a corresponding second seat axis, wherein the second seat axis and the second belt axis are at a second predetermined angle relative to each other, such that the first predetermined angle and the second predetermined angle are less than 180 degrees.

2. The baby carrier according to claim 1, wherein said at least one positioning system is configured such that the first predetermined angle is selectable from a first plurality of predetermined angles, and the second predetermined angle is selectable from a second plurality of predetermined angles.

3. The baby carrier according to claim 1, further comprising a seat insert configured to be enclosed in the seat component to support a weight of a baby.

4. The baby carrier according to claim 1, wherein the at least one positioning system is configured such that, in a deployed mode on a person, the seat component extends away from a frontal plane of the person.

5. The baby carrier according to claim 1, wherein the first predetermined angle and the second predetermined angle are determined based on a size of a user's baby.

6. The baby carrier according to claim 1, wherein the first predetermined angle and the second predetermined angle are determined based on a size of a user's torso.

7. The baby carrier according to claim 1, wherein the at least one waist belt further comprises a first portion comprising the first terminal end and a second portion comprising the second terminal end, wherein the first portion and the second portion are configured to be releasably coupled.

8. A baby carrier comprising:

a main panel;

at least one waist belt comprising at least one terminal end;

a seat component, configured to couple to the main panel at a medial region of the seat component, the seat component comprising at least one terminal end extending from a side region of the seat component; and, a pair of shoulder straps coupled to the main panel, wherein the at least one terminal end of the at least one waist belt is configured to couple to the at least one terminal end of the seat component such that:

the at least one terminal end of the at least one waist belt is extending along a corresponding first axis, and the at least one terminal end of the seat component extends along a corresponding second axis, such that, when the at least one terminal end of the at least one waist belt and the at least one terminal end of the seat component are coupled, the second axis and the first axis are oriented at a predetermined angle relative to each other.

9. The baby carrier according to claim 8, wherein the at least one waist belt and the at least one seat component are configured such that the first predetermined angle is selectable from a first plurality of predetermined angles.

10. The baby carrier according to claim 8, wherein the at least one terminal end of the at least one waist belt releasably couples to the at least one terminal end of the seat component.

11. The baby carrier according to claim 8, further comprising a seat insert configured to be enclosed in the seat component to support a weight of a baby.

12. The baby carrier according to claim 8, further comprising at least one side panel coupled to the side region of the seat component and coupled to the at least one terminal end such that the at least one terminal end extends from the side region of the seat component.

13. The baby carrier according to claim 8, wherein the predetermined angle is less than 180 degrees.

14. The baby carrier according to claim 8, wherein the predetermined angle is determined based on a size of a user's baby.

15. The baby carrier according to claim 8, wherein the predetermined angle is determined based on a size of a user's torso.

16. A baby carrier comprising:

a seat compartment;

at least one side panel coupled to a side region of the seat compartment and comprising a terminal end;

a pair of shoulder straps configured to support the seat compartment;

at least one waist belt comprising at least one terminal end; and at least one positioning system configured to couple the terminal end of the at least one side panel to the at least one terminal end of the at least one waist belt, such that:

the at least one terminal end of the at least one waist belt is extending along a corresponding first axis, and the terminal end of the at least one side panel extends along a corresponding second axis, such that, when the at least one terminal end of the at least one waist belt and the terminal end of the at least one side panel are releasably coupled, the second axis and the belt axis are oriented at a predetermined angle relative to each other.

17. The baby carrier according to claim 16, wherein said at least one positioning system is configured such that the predetermined angle is selectable from a plurality of predetermined angles.

18. The baby carrier according to claim 16, wherein said at least one waist belt engages with at least one restraint system.

19. The baby carrier according to claim 16, further comprising a seat insert configured to be enclosed in the seat compartment to support a weight of a baby.

20. The baby carrier according to claim 16, wherein the predetermined angle is less than 180 degrees.

* * * * *